US012514371B2

(12) United States Patent
Lu

(10) Patent No.: US 12,514,371 B2
(45) Date of Patent: Jan. 6, 2026

(54) DECK CHAIR WITH SUPPORT FOOT AND LINKED FOLDING AND UNFOLDING MECHANISM

(71) Applicant: ZHEJIANG ZHENDONG LEISURE PRODUCTS CO., LTD, Zhejiang (CN)

(72) Inventor: Xiudong Lu, Zhejiang (CN)

(73) Assignee: ZHEJIANG ZHENDONG LEISURE PRODUCTS CO., LTD., Zhejiang (CN)

( * ) Notice: Subject to any disclaimer, the term of this patent is extended or adjusted under 35 U.S.C. 154(b) by 224 days.

(21) Appl. No.: 18/488,054

(22) Filed: Oct. 17, 2023

(65) Prior Publication Data

US 2025/0000263 A1 Jan. 2, 2025

(30) Foreign Application Priority Data

Jun. 28, 2023 (CN) ..... 202321653029.0

(51) Int. Cl.

| | |
|---|---|
| ***A47C 1/14*** | (2006.01) |
| ***A47C 4/00*** | (2006.01) |
| ***A47C 4/28*** | (2006.01) |
| ***A47C 7/50*** | (2006.01) |
| ***A47C 7/54*** | (2006.01) |

(52) U.S. Cl.

CPC ..... *A47C 4/00* (2013.01); *A47C 7/5068* (2018.08); *A47C 7/541* (2018.08); *A47C 1/14* (2013.01); *A47C 1/143* (2013.01); *A47C 4/28* (2013.01)

(58) Field of Classification Search

CPC .. A47C 1/14; A47C 1/143; A47C 4/28; A47C 7/5068

See application file for complete search history.

(56) References Cited

U.S. PATENT DOCUMENTS

| | | | | | |
|---|---|---|---|---|---|
| 597,480 | A * | 1/1898 | Fellows | A47C 1/143 | 297/19 |
| 655,593 | A * | 8/1900 | Webb | A47C 7/666 | 135/96 |
| 663,486 | A * | 12/1900 | Boren | A47C 1/143 | 297/19 |
| 2,216,317 | A * | 10/1940 | Karish | A47C 17/163 | 297/19 X |

(Continued)

FOREIGN PATENT DOCUMENTS

CN 215076900 12/2021

*Primary Examiner* — Rodney B White

(74) *Attorney, Agent, or Firm* — JCIPRNET

(57) ABSTRACT

The present disclosure discloses a deck chair with a support foot and a linked folding and unfolding mechanism, including a back rest portion, a chair seat portion, a footstool portion, and a linked folding and unfolding mechanism, wherein the support foot is disposed in back of the back rest portion; the linked folding and unfolding mechanism includes a folding and unfolding rod and a linkage rod; one end of the folding and unfolding rod is cooperatively hinged to the support foot; an upper portion of the support foot is cooperatively hinged to the back rest portion; when the back rest portion changes from a vertical state to a lie-low state, the support foot is supported by the folding and unfolding rod, and an angle between the support foot and the back rest portion gradually increases.

9 Claims, 6 Drawing Sheets

(56) References Cited

U.S. PATENT DOCUMENTS

| | | | | |
|---|---|---|---|---|
| 5,423,592 | A * | 6/1995 | Spurrier | A47C 1/143 297/354.13 X |
| 6,113,181 | A * | 9/2000 | Tang | A47C 7/506 297/354.13 X |
| 10,722,039 | B2 * | 7/2020 | Weldon | B62B 1/12 |
| 2018/0344032 | A1 * | 12/2018 | Eskridge, III | A47C 1/026 |
| 2022/0202187 | A1 * | 6/2022 | Rangel | A61G 15/002 |

* cited by examiner

DECK CHAIR WITH SUPPORT FOOT AND LINKED FOLDING AND UNFOLDING MECHANISM

CROSS-REFERENCE TO RELATED APPLICATION

This application claims the priority benefit of China application serial no. 202321653029.0, filed on Jun. 28, 2023. The entirety of the above-mentioned patent application is hereby incorporated by reference herein and made a part of this specification.

BACKGROUND

Technical Field

The present invention relates to the technical field of deck chairs, and more particularly to a deck chair with a support foot and a linked folding and unfolding mechanism.

Description of Related Art

Existing deck chairs have various varieties, are mostly used indoor, and have the main advantages of greatly saving occupancy space and facilitating storage. The existing deck chair mainly consists of a bracket, a face frame, and fabric. After being unfolded, the deck chair can be used for a user to rest, both for sitting and lying down. Although the existing deck chair can provide a large lie-low size, the existing deck chair still cannot achieve the lie-low effect. Therefore, the patent No. CN215076900U discloses a foldable flat deck chair, including a chair face frame, chair legs, and a chair back, wherein the chair face frame is hinged to the chair back, and is connected to the chair legs; a hinge block 1 is connected between the chair face frame and the chair back; and a middle part of the hinge block 1 is connected to a fixing apparatus for fixing the chair face frame and the chair back.

The above product is an early product of the applicant. With the wide application of the product on the market, a large number of user feedbacks are obtained at present, and the core technical defect is that when a user needs to lie low, the user would be easy to directly lie low without unfolding a support frame, and is therefore easy to flip back, thus having a certain potential safety hazard.

SUMMARY

In order to solve the above problem, the present invention provides a deck chair with a support foot and a linked folding and unfolding mechanism, which may implement automatic floor support and improve use convenience and safety.

The technical problems to be solved by the present invention may be implemented by adopting the following technical solutions:

A deck chair with a support foot and a linked folding and unfolding mechanism, including a back rest portion, a chair seat portion, a footstool portion, and a linked folding and unfolding mechanism, wherein the support foot is disposed in back of the back rest portion; the linked folding and unfolding mechanism includes a folding and unfolding rod and a linkage rod; one end of the folding and unfolding rod is cooperatively hinged to the support foot; an upper portion of the support foot is cooperatively hinged to the back rest portion; a hinge position of the folding and unfolding rod and the support foot is lower than a horizontal plane in which a hinge position of the support foot and the back rest portion is located; the other end of the folding and unfolding rod is cooperatively hinged to one end of the linkage rod; the other end of the linkage rod is fixedly mounted at the chair seat portion; when the back rest portion changes from a vertical state to a lie-low state, the support foot is supported by the folding and unfolding rod, and an angle between the support foot and the back rest portion gradually increases; and when the back rest portion changes from the lie-low state to the vertical state, the support foot is pulled by the folding and unfolding rod, and the angle between the support foot and the back rest portion gradually decreases.

When a bottom of the support foot is in contact with the ground, an open angle between the support foot and the back rest portion is maximum.

The folding and unfolding rod includes a straight folding and unfolding rod portion and a bending folding and unfolding rod portion; the straight folding and unfolding rod portion is cooperatively hinged to the support foot; and the bending folding and unfolding rod portion is cooperatively hinged to the linkage rod.

The support foot includes support foot bodies located on two sides; a hinge base is disposed at an upper end of the support foot body; the hinge base is cooperatively hinged to the back rest portion by means of a first hinge shaft; and one end of the straight folding and unfolding rod portion is cooperatively hinged to the support foot body by means of a second hinge shaft.

The support foot body on any side is cooperatively mounted at the folding and unfolding rod on the same side.

Bottoms of the support foot bodies on two sides are connected to a support foot rod, and the support foot is in a "U" shape as a whole.

A hinge pedestal is disposed between the back rest portion and the chair seat portion; the back rest portion can move relative to the chair seat portion by means of the hinge pedestal; a limit shaft is disposed on the hinge pedestal; and the limit shaft extends outwards, and cooperatively presses against a wall of a back leg pipe.

The deck chair further includes a chair leg portion; the chair leg portion includes front leg pipes, back leg pipes, and handrail pipes; upper ends of the front leg pipes and upper ends of the back leg pipes are cooperatively mounted by means of hinged mounting bases; an upper portion of the hinged mounting base is cooperatively mounted at the handrail pipe; and a back end of the handrail pipe is cooperatively hinged to the back rest portion.

An upper end of the footstool portion is cooperatively hinged to the chair seat portion; a support mechanism is disposed between the footstool portion and the back rest portion; and when the back rest portion moves backwards and gradually lies low, the support mechanism supports the footstool portion to deflect outwards and upwards.

The support mechanism includes a support foot and a connecting rod; one end of the support rod is cooperatively hinged to the footstool portion, and the other end is cooperatively hinged to one end of the connecting rod; and the other end of the connecting rod is fixedly mounted at the back rest portion.

Compared with the prior art, the present invention has the following beneficial effects: the present invention optimizes the design, adopts the linked folding and unfolding mechanism, and may implement automatic floor support, thus improving use convenience and safety; the present invention optimizes the support mechanism, such that the footstool portion is linked with the back rest portion, thus facilitating the lie-low use of a user at leisure.

The features of the present invention can be clearly understood with reference to the drawings and the detailed description of the following preferred embodiments.

DESCRIPTION OF THE EMBODIMENTS

Figure 1:
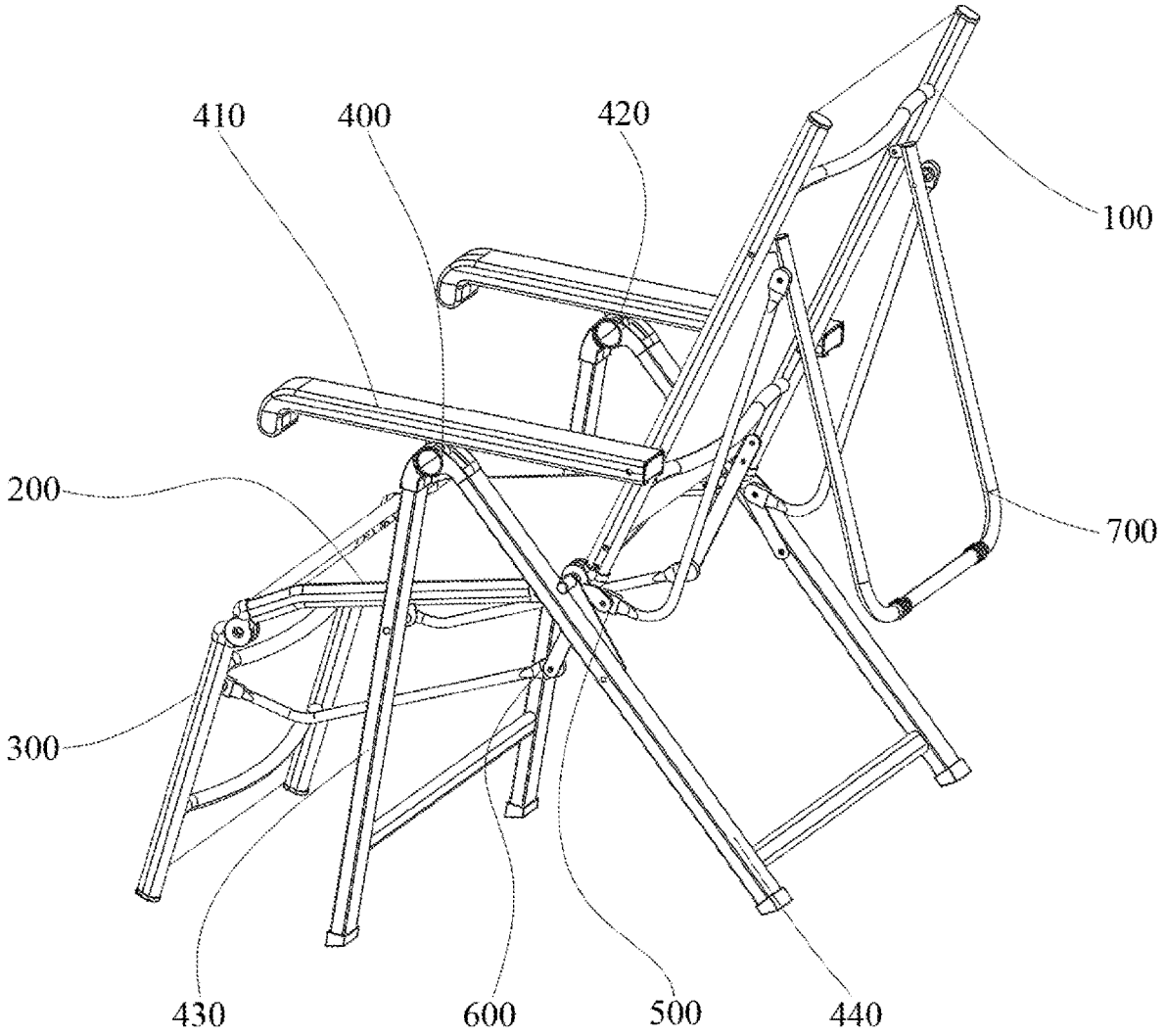
FIG. 1 is a structural schematic view of the entire deck chair in a half lying state according to the present invention.
Figure 2:
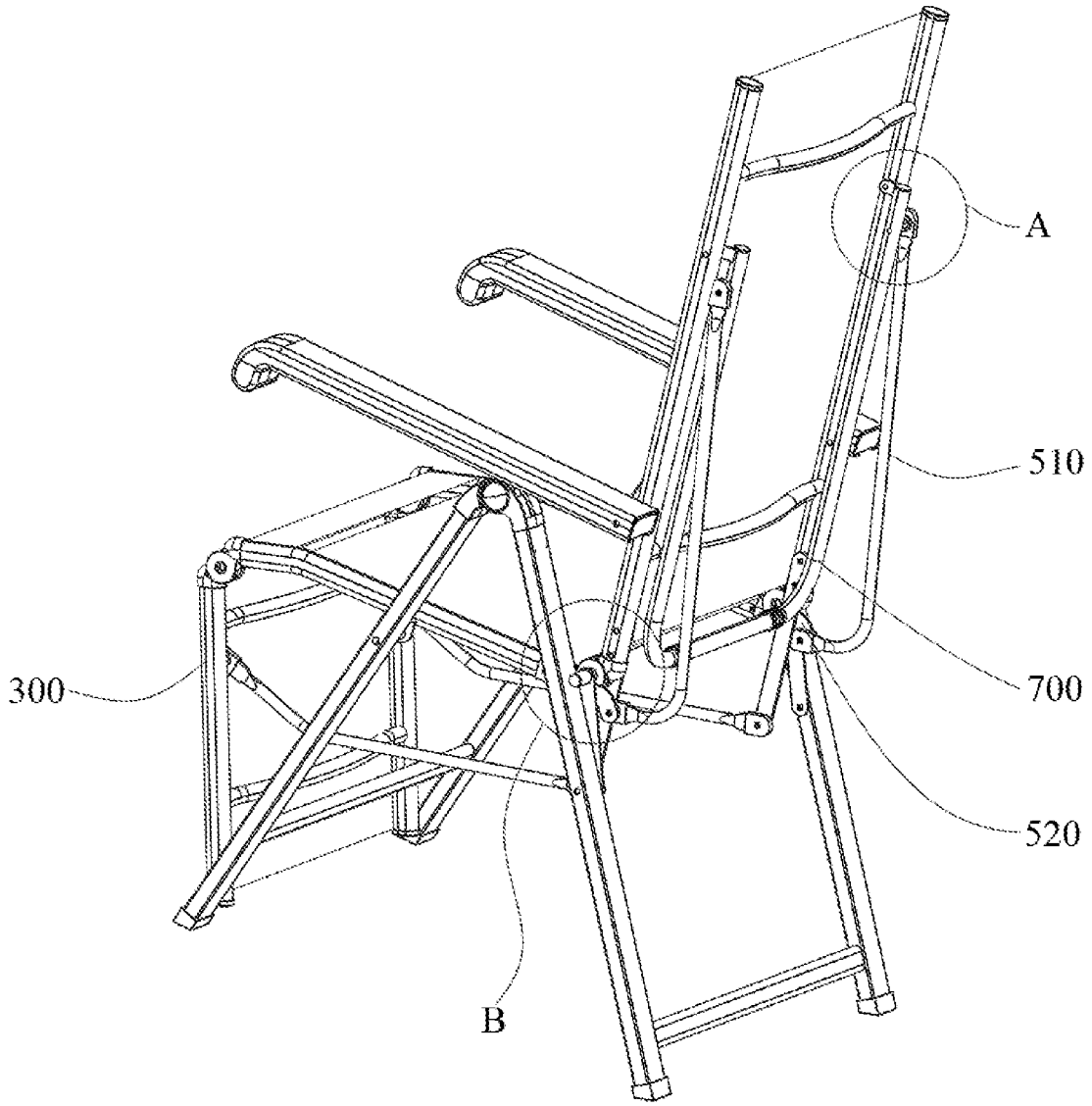
FIG. 2 is a structural schematic view of the entire deck chair in a vertical state according to the present invention.
Figure 3:
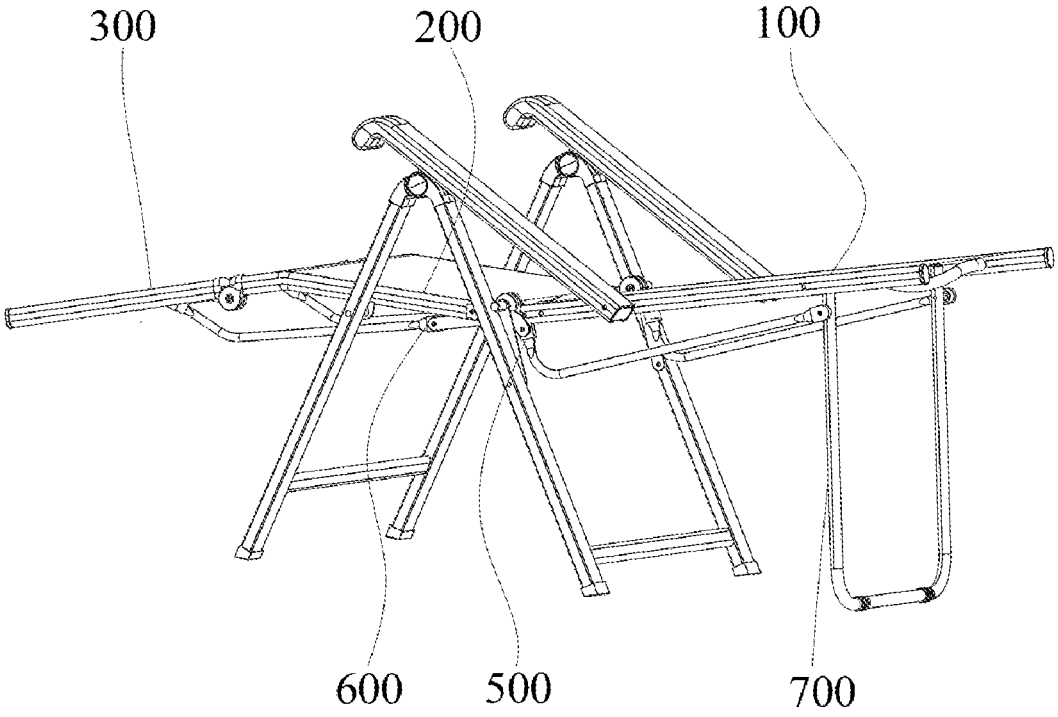
FIG. 3 is a structural schematic view of the entire deck chair in a lie-low state according to the present invention.
Figure 4:
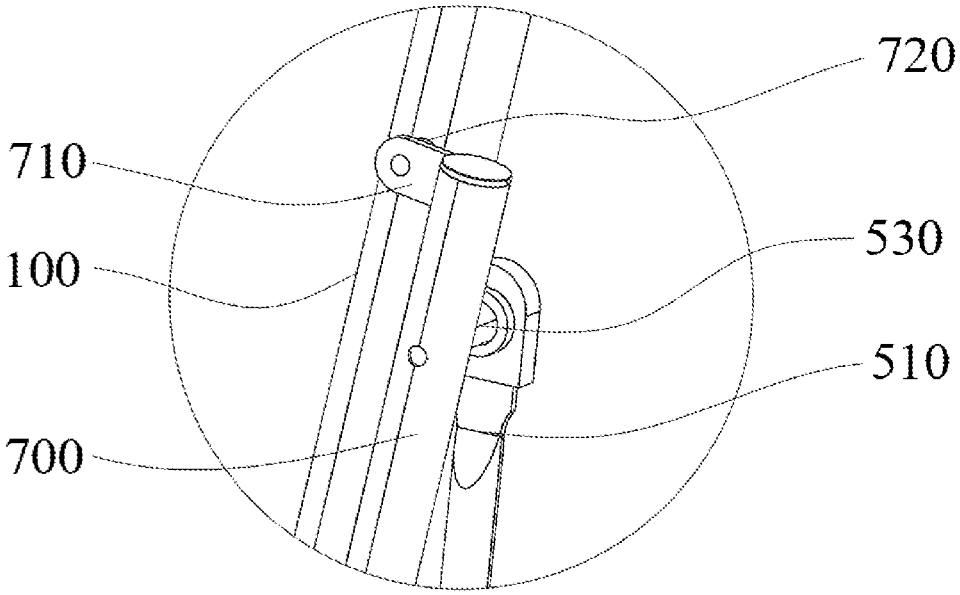
FIG. 4 is a partial enlarged structural schematic view of A in FIG. 2.
Figure 5:
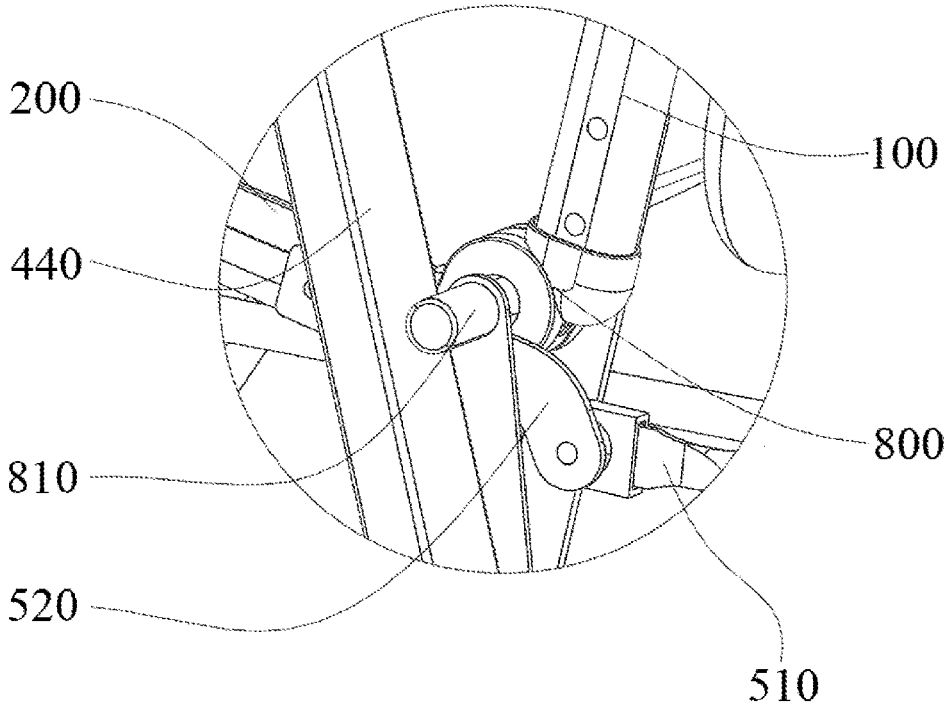
FIG. 5 is a partial enlarged structural schematic view of B in FIG. 2.
Figure 6:
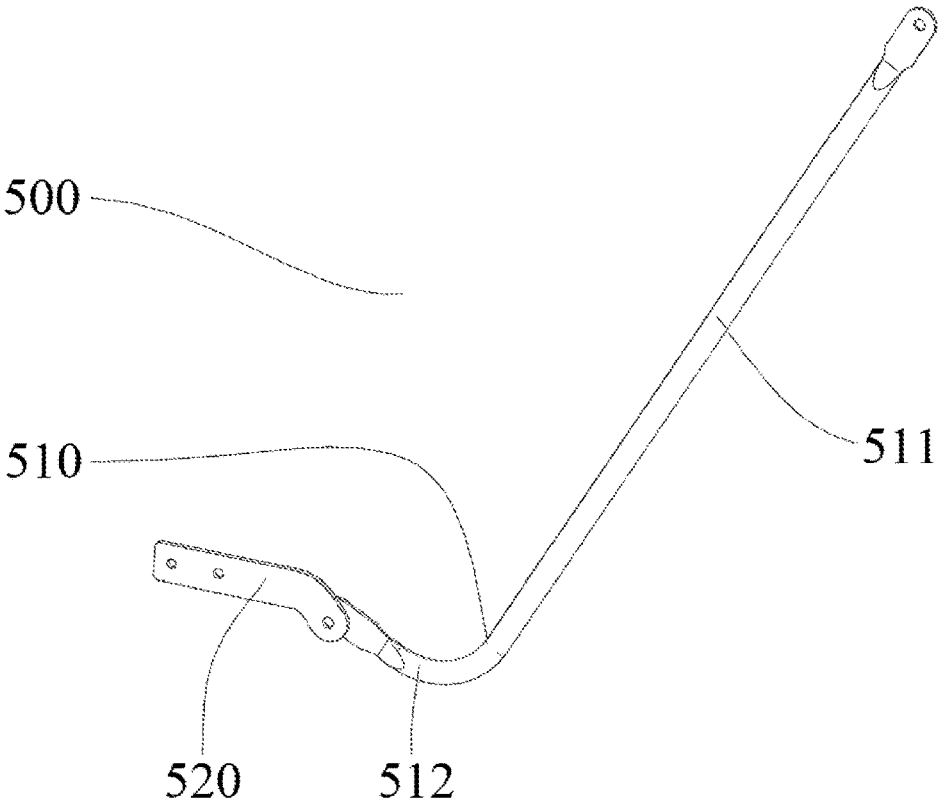
FIG. 6 is a structural schematic view of a linked folding and unfolding mechanism according to the present invention.
Figure 7:
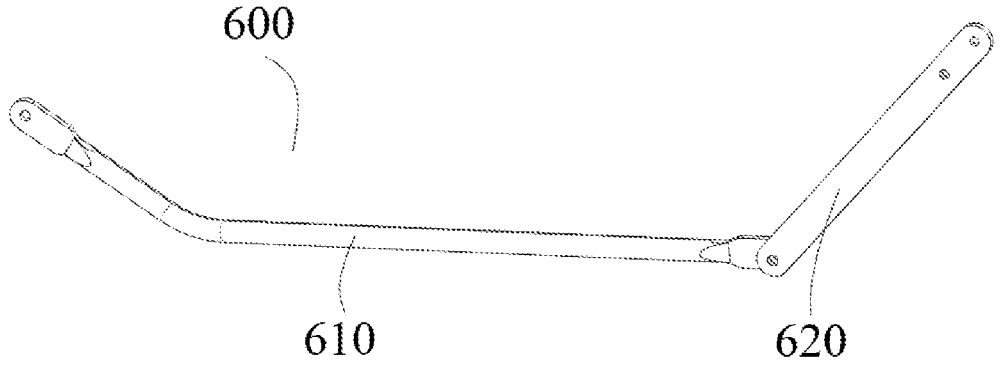
FIG. 7 is a structural schematic view of a support mechanism according to the present invention.

In order to easily understand the technical means, creative features, objectives, and effects achieved by the present invention, the present invention will be further described below with reference to specific drawings.

As shown in FIG. 1 to FIG. 9, the present embodiment discloses a deck chair with a support foot and a linked folding and unfolding mechanism, comprising a back rest portion 100, a chair seat portion 200, and a footstool portion 300, wherein the back rest portion 100 and the chair seat portion 200 are provided with a hinge pedestal 800 therebetween; the back rest portion 100 can move relative to the chair seat portion 200 by means of the hinge pedestal 800; an upper end of the footstool portion 300 is cooperatively hinged to the chair seat portion 200; the deck chair is preferably provided with three position structures which provide convenience for a user to sit, half-lie, or lie low, having good sitting experience; when the deck chair is in a lie-low state, the user may conveniently lie low like on bed, facilitating the rest of the user.

In a specific structure, a support foot 700 is disposed in back of the back rest portion 100; the support foot 700 is used to support the back rest portion 100; when the deck chair is in the lie-low state, the back rest portion 100 implements floor support by means of the support foot 700, such that the user can more steadily lie low for rest. The support foot 700 cooperates with the linked folding and unfolding mechanism 500; the linked folding and unfolding mechanism 500 is used to automatically unfold and support the support foot 700, so as to avoid the potential safety hazard because the support foot cannot support in position when the deck chair is in the lie-low state.

The linked folding and unfolding mechanism 500 includes a folding and unfolding rod 510 and a linkage rod 520; one end of the folding and unfolding rod 510 is cooperatively hinged to the support foot 700; an upper portion of the support foot 700 is cooperatively hinged to the back rest portion 100; a hinge position of the folding and unfolding rod 510 and the support foot 700 is lower than a horizontal plane in which a hinge position of the support foot 700 and the back rest portion 100 is located; the other end of the folding and unfolding rod 510 is cooperatively hinged to one end of the linkage rod 520; the other end of the linkage rod 520 is fixedly mounted at the chair seat portion 200; when the back rest portion 100 changes from a vertical state to a lie-low state, the support foot 700 is supported by the folding and unfolding rod 510, and an angle between the support foot 700 and the back rest portion 100 gradually increases; when a bottom of the support foot 700 is in contact with the ground, an open angle between the support foot 700 and the back rest portion 100 is maximum; when the back rest portion 100 changes from the lie-low state to the vertical state, the support foot 700 is pulled by the folding and unfolding rod 510, and the angle between the support foot 700 and the back rest portion 100 gradually decreases. In the above structure, the back rest portion 100 can turn over, such that the folding and unfolding rod 510 moves with the back rest portion 100; under the limit of the hinge position of the linkage rod 520, the other end of the folding and unfolding rod 510 persistently limits the position of the support foot 700; the two ends of the support foot 700 are limited by the hinge positions, namely the hinge position of the support foot 700 and the back rest portion 100 and the hinge position of the support foot 700 and the folding and unfolding rod 510; with the lie-low of the back rest portion 100, the folding and unfolding rod 510 also synchronously lies low; under the synchronous limit of the two hinge positions, the support foot 700 persistently rotates, until in contact with the ground, so as to automatically unfold and support the support foot 700.

The folding and unfolding rod 510 includes a straight folding and unfolding rod portion 511 and a bending folding and unfolding rod portion 512; one end of the straight folding and unfolding rod portion 511 is cooperatively hinged to the support foot 700; and one end of the bending folding and unfolding rod portion 512 is cooperatively hinged to the linkage rod 520. The design of the bending folding and unfolding rod portion 512 is optimized; by using a bending pipe structure, a good transmission transition can be implemented, thus achieving a good linked support effect, and facilitating the automatic folding and unfolding of the support foot 700.

Figure 8:
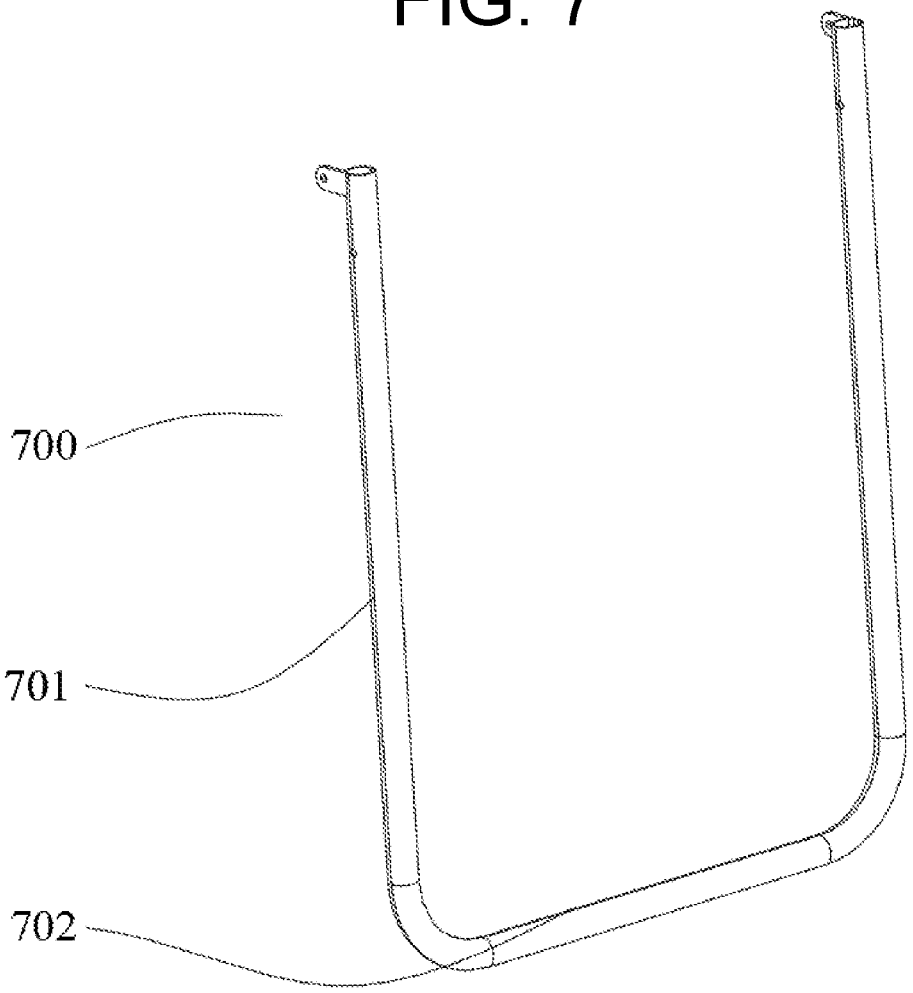
FIG. 8 is a first structural schematic view of a support foot according to the present invention.

According to the above descriptions, the support foot 700 includes support foot bodies 701 located on two sides; a hinge base 710 is disposed at an upper end of the support foot body 701; the hinge base 710 is cooperatively hinged to the back rest portion 100 by means of a first hinge shaft 720; and one end of the straight folding and unfolding rod portion 511 is cooperatively hinged to the support foot body 701 by means of a second hinge shaft 530. In another preferred embodiment, as shown in FIG. 8, bottoms of the support foot bodies 701 on two sides are connected to a support foot rod 702; the support foot 700 is in a "U" shape as a whole, wherein the support foot can structurally match with a folding and unfolding rod on a single side, so as to implement automatic folding and unfolding.

Figure 9:
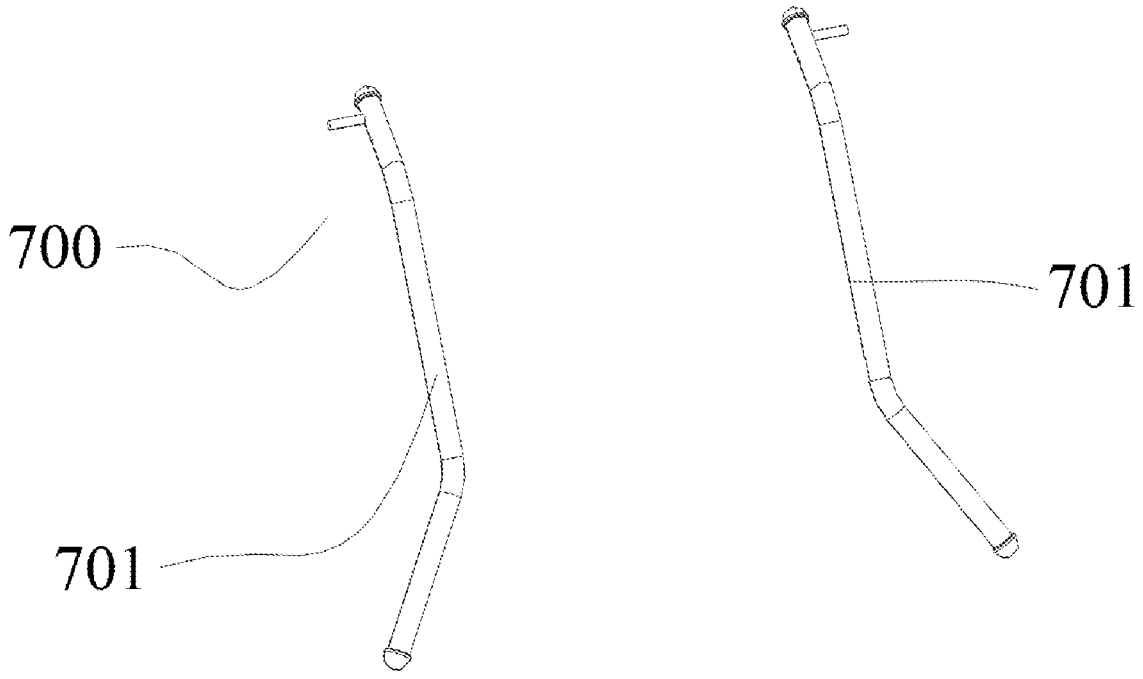
FIG. 9 is a second structural schematic view of the support foot according to the present invention.

In another embodiment, as shown in FIG. 9, the support foot body 701 can be an independent component, and the support foot body 701 on any side is cooperatively mounted at the folding and unfolding rod 510 on the same side.

According to the above descriptions, a hinge pedestal 800 is disposed between the back rest portion 100 and the chair seat portion 200; a limit shaft 810 is disposed on the hinge pedestal 800; the limit shaft 810 extends outwards, and cooperatively presses against a wall of a back leg pipe 440;

the deck chair further includes a chair leg portion 400; the chair leg portion 400 includes front leg pipes 430, back leg pipes 440, and handrail pipes 410; upper ends of the front leg pipes 430 and upper ends of the back leg pipes 440 are cooperatively mounted by means of hinged mounting bases 420; an upper portion of the hinged mounting base 420 is cooperatively mounted at the handrail pipe 410; and a back end of the handrail pipe 410 is cooperatively hinged to the back rest portion 100. The hinge pedestal 800 is optimized, such that the back rest portion 100 is movably hinged to the chair seat portion 200; furthermore, the limit shaft 810 is preferably provided; the limit shaft 810 and the back leg pipe 440 press against each other, so as to improve the stability of the deck chair.

Preferably, a support mechanism 600 is disposed between the footstool portion 300 and the back rest portion 100; when the back rest portion 100 moves backwards and gradually lies low, the support mechanism 600 supports the footstool portion 300 to deflect outwards and upwards; the support mechanism 600 includes a support rod 610 and a connecting rod 620; one end of the support rod 610 is cooperatively hinged to the footstool portion 300, and the other end is cooperatively hinged to one end of the connecting rod 620; the other end of the connecting rod 620 is fixedly mounted at the back rest portion 100; The support mechanism 600 is optimized, such that the footstool portion 300 can be synchronously linked with the back rest portion 100 under the action of the support rod 610, thus facilitating the lie-low of the deck chair.

The present invention optimizes the design, adopts the linked folding and unfolding mechanism, and may implement automatic floor support, thus improving use convenience and safety; and the present invention optimizes the support mechanism, such that the footstool portion is linked with the back rest portion, thus facilitating the lie-low use of a user at leisure.

The descriptions above are only preferred embodiments of the present invention, but not intended to limit the present invention in any form; and any simple amendments, equivalent variations and modifications made to the above embodiments on the basis of the technical principle of the present invention shall still be concluded in the scope of protection of the technical solution of the present invention.

What is claimed is:

1. A deck chair with a support foot, comprising a back rest portion, a chair seat portion, a footstool portion, and a linked folding and unfolding mechanism, wherein the support foot is disposed in a back of the back rest portion; the linked folding and unfolding mechanism comprises a folding and unfolding rod and a linkage rod; one end of the folding and unfolding rod is cooperatively hinged to the support foot; an upper portion of the support foot is cooperatively hinged to the back rest portion; a hinge position of the folding and unfolding rod and the support foot is lower than a horizontal plane in which a hinge position of the support foot and the back rest portion is located; another end of the folding and unfolding rod is cooperatively hinged to one end of the linkage rod; another end of the linkage rod is fixedly mounted at the chair seat portion; when the back rest portion changes from a vertical state to a lie-low state, the support foot is supported by the folding and unfolding rod, and an angle between the support foot and the back rest portion gradually increases; and when the back rest portion changes from the lie-low state to the vertical state, the support foot is pulled by the folding and unfolding rod, and the angle between the support foot and the back rest portion gradually decreases.

2. The deck chair with the support foot according to claim 1, wherein when a bottom of the support foot is in contact with a ground, an open angle between the support foot and the back rest portion is maximum.

3. The deck chair with the support foot according to claim 2, wherein the support foot comprises support foot bodies located on two sides of the support foot; a hinge base is disposed at an upper end of each of the support foot bodies; the hinge base is cooperatively hinged to the back rest portion by means of a first hinge shaft; and one end of the straight folding and unfolding rod portion is cooperatively hinged to one of the support foot bodies by means of a second hinge shaft.

4. The deck chair with the support foot according to claim 3, wherein bottoms of the support foot bodies on two sides of the support foot are connected to a support foot rod, and the support foot is in a "U" shape as a whole.

5. The deck chair with the support foot according to claim 1, wherein the folding and unfolding rod comprises a straight folding and unfolding rod portion and a bending folding and unfolding rod portion; the straight folding and unfolding rod portion is cooperatively hinged to the support foot; and the bending folding and unfolding rod portion is cooperatively hinged to the linkage rod.

6. The deck chair with the support foot according to claim 1, wherein a hinge pedestal is disposed between the back rest portion and the chair seat portion; the back rest portion is configured to move relative to the chair seat portion by means of the hinge pedestal; a limit shaft is disposed on the hinge pedestal; and the limit shaft extends outwards and cooperatively presses against a wall of a back leg pipe.

7. The deck chair with the support foot according to claim 6, wherein the deck chair further comprises a chair leg portion; the chair leg portion comprises front leg pipes, back leg pipes, and handrail pipes; upper ends of the front leg pipes and upper ends of the back leg pipes are cooperatively mounted by means of hinged mounting bases; upper portions of the hinged mounting bases are cooperatively mounted at the handrail pipes; and back ends of the handrail pipes are cooperatively hinged to the back rest portion.

8. The deck chair with the support foot according to claim 7, wherein an upper end of the footstool portion is cooperatively hinged to the chair seat portion; a support mechanism is disposed between the footstool portion and the back rest portion; and when the back rest portion moves backwards and gradually lies low, the support mechanism supports the footstool portion to deflect outwards and upwards.

9. The deck chair with the support foot according to claim 8, wherein the support mechanism comprises a support rod and a connecting rod; one end of the support rod is cooperatively hinged to the footstool portion, and another end of the support rod is cooperatively hinged to one end of the connecting rod; and another end of the connecting rod is fixedly mounted at the back rest portion.

* * * * *